United States Patent [19]

Fraser

[11] 4,359,809

[45] Nov. 23, 1982

[54] TUBULAR FURNITURE CONSTRUCTION

[75] Inventor: Graham Fraser, Lindsay, Canada

[73] Assignee: Lindsay Specialty Products Limited, Lindsay, Canada

[21] Appl. No.: 246,930

[22] Filed: Mar. 24, 1981

[51] Int. Cl.[3] ..... A47C 31/02

[52] U.S. Cl. ..... 24/265 C; 160/404; 160/DIG. 15

[58] Field of Search ..... 24/265 C, 72.7, 289, 24/296, 293, 129 C, 114.5, 261 R, 201 A, 131 R, 230.5 N; 160/DIG. 15, 404, 382, 383

[56] References Cited

U.S. PATENT DOCUMENTS

| | | | |
|---|---|---|---|
| 2,220,825 | 11/1940 | Place | 24/296 |
| 2,692,414 | 5/1952 | Poupitch | 24/293 |
| 2,830,350 | 6/1954 | Wootton | 160/382 |
| 2,884,994 | 5/1959 | Rosalsky | 24/265 C |
| 3,358,742 | 12/1967 | Sanderson | 24/265 C |
| 3,604,073 | 9/1971 | Green | 24/265 C |
| 3,710,422 | 1/1973 | van Halteren | 24/265 C |
| 3,910,339 | 10/1975 | Kramer | 24/265 C |

*Primary Examiner*—Paul J. Hirsch
*Assistant Examiner*—David Tarnoff
*Attorney, Agent, or Firm*—Fetherstonhaugh & Co.

[57] ABSTRACT

The invention is a clip used to clip the edge of a web that forms a seat or back of a lawn chair having a tubular frame. The clip is made from a single piece of wire bent into a T-shape with a stem the T-stem having a hook and a C-shaped hole searching lead section which is designed to engage the inside wall of a tube in use to maintain the axis of a hook section extending in a forward direction.

4 Claims, 8 Drawing Figures

TUBULAR FURNITURE CONSTRUCTION

This invention generally relates to chairs of the type that have a tubular frame; and seats and backs made from a webbing material secured to the frame.

The term webbing material in this specification is used in its broad sense to include woven as well as nonwoven fabrics and to include strips as well as sheets. The requirement is to clip the edge of a web of any kind of material in any form to the tubular frame of a piece of furniture. The specification will describe the invention in the clipping of a strip of material to a frame. As indicated, however, it is not intended that this particular type or shape of webbing limit the invention.

The securement of webbing to the frames is an important aspect of the manufacture of this type of furniture. The furniture is usually relatively inexpensive and it is important that the cost of securing the webbing to the frames should not be high. It is also important that the means used to secure the webbing to the frame should be reliable because if the securement means should fail, the piece of furniture is returned to the manufacturer for repair or replacement. The cost of repairing or replacing one piece may amount to the manufacturer's profit on many pieces.

There are many ways known and used for securing webbing to the frames, and quite often, the selection of a securing means will depend on the physical characteristics of the webbing. Clips that enter into a hold in the edge of the webbing and then snap into place in a hole in the frame are commonly used in cases where the webbing has a degree of elasticity that will permit the clip to be snapped into the frame by manual application. The web elasticity then exerts a holding tension on the clip against removal. Such clips have proven themselves to be inexpensive and sufficiently reliable for many classes of furniture. Rivetting of the strips of webbing to the frame is more reliable but also more costly.

Webbing commonly used in large volume on this kind of furniture, in the past, has been relatively light and stretchable so that with the lightweight stretchable webbing the clip has tended to be the most popular type of securement. A typical clip is one described in Canadian Patent No. 611,190. This clip has an inwardly projecting prong that extends through the webbing and through a slot in the tubing; but in order to insert the prong into the tubing, the clip and web must be stretched around the tubing to permit the tip of the rearwardly extending prong to enter the hole in the tubing. Once entered, the stretched webbing reasserts itself to retain the clip firmly in the slot and the web secured to the frame.

The application and efficiency of this prior clip depends on the elastic properties of the webbing. Similar considerations apply to many of the prior clip designs in common use. They depend upon the resilience of the webbing.

Over the past number of years, there has been a growing popularity of more rigid and less stretchable nonwoven extruded types of webbing materials. With most of these less stretchable materials the popular clips will not work well because these rigid materials do not stretch enough to permit practical insertion of the clip in the tubing. Alternative securement means have been used. Rivets and self-tapping screws have been used with success. They are each reliable securement means but relatively expensive and add to the cost of a very competitive item of manufacture. Another method of securement involves plasticizing of a locking formation in the end of the strip to deform it for entry into a hole in the frame. On cooling the material again becomes rigid and locks itself to the frame. This method is relatively costly.

Thus, the position in the trade prior to this invention was that there were alternative reliable nonclip means available for securing heavy less stretchable plastic webbing to frames but they were relatively costly or inconvenient when compared to a clip. There were no satisfactory clip designs available for securing these heavy webbing materials to their frames.

The object of this invention is to provide a clip capable of securing a nonelastic web to the tubular frame of a piece of furniture or the like that is inexpensive, convenient, reliable and easy to use. With this and other objects in view, a clip according to this invention for securing the end of a web to a tubular frame comprises a single piece of wire bent into a T-shape in front elevation having a T-bar constituted by the two end portions of the piece of wire and a T-stem extending downwardly from the T-bar; said T-stem in side elevation of said clip having a hook section that extends from said T-bar and a C-shaped hole searching lead section, the hook section and the lead section merging in a U-bend, the front of the C-shaped lead section in use being adapted to engage with the inside of a tube wall to maintain the axis of the hook section extending in a forward direction. Put in an alternative way the C-section and the hook section form a double U-bend.

The invention will be clearly understood after reference to the following detailed specification read in conjunction with the drawings.

Figure 1:
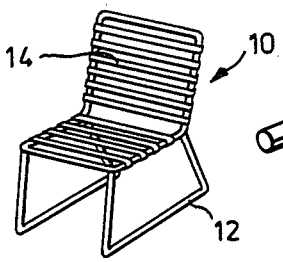
FIG. 1 is an illustration of a chair with a tubular metal frame having seat and back made from strips of webbing material that are secured to the frame with clips according to this invention.

In the drawings, the numeral 10 generally refers to a chair having a frame 12 of a tubular metal material such as aluminum and a seat and back portion that is made from strips of webbing 14 of a relatively heavy nonstretchable plastic material such as polyethylene. This invention is concerned with a clip for securing the free ends of the webbing strips 14 to the frame.

Figure 2:
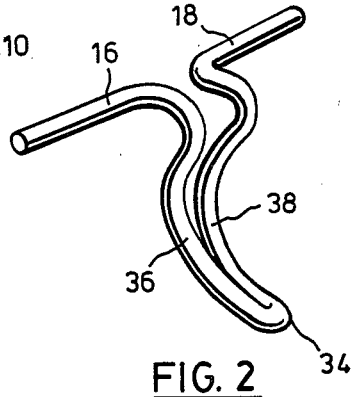
FIG. 2 is a perspective illustration of a clip according to this invention.
Figure 3:
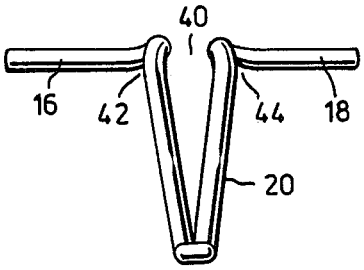
FIG. 3 is a perspective illustration of a clip showing T-shape in front elevation.

A clip according to the invention is illustrated in FIG. 2. This clip is formed from a single piece of wire bent into a shape that is T-shaped in front elevation as seen in FIG. 3 and having a T-bar constituted by the two end portions 16 and 18 of the piece of wire and a T-stem 20 extending downwardly from the T-bar.

The clip is shown in side elevation in any of the FIGS. 5 to 8 inclusive from which it will be seen that the T-stem has a hook section 22, a C-shaped lead section 24; the hook section and the C-shaped lead section merging to a U-bend 26.

Figure 4:
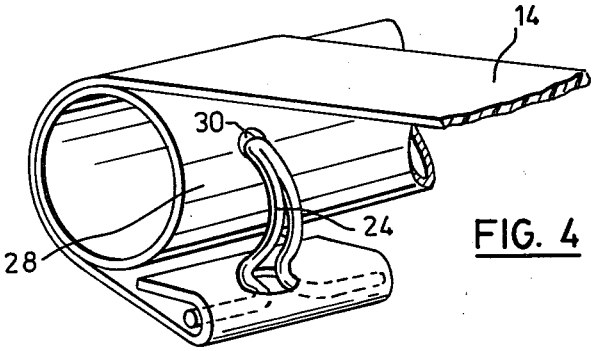
FIG. 4 is an illustration of a free end of a tube similar to the tubing from which the frame of a chair of FIG. 1 is made, punched with an opening to receive the clip, for the purpose of illustrating the manner in which the clip is secured to the tubed frame.

Reference will now be had to FIGS. 4 to 8 inclusive which illustrate the manner of securing the clip to a frame. It will be understood that the piece of metal tubing 28 is employed for the purposes of illustration only because in the chair illustrated in FIG. 1, the tubing does not terminate in a free end as illustrated in FIG. 4. Tubing 28 is similar tubing to the tubing of frame 12.

The tubing is punched with a hole 30 to receive the stem of the clip. The webbing 14 is formed with a hole adjacent its free end and the stem of the clip is inserted through the hole in the webbing as the free end of the webbing is folded about the bar of the clip as illustrated in FIG. 4.

The webbing has very little stretch or elasticity and one cannot rotate the clip assembly around the tube to carry the bar of a clip beyond the hole for the purpose of inserting the free end of the stem into the hole 30 because the stretch of the webbing will not permit it.

Figure 5:
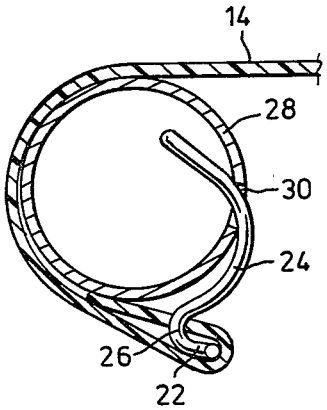
FIG. 5 is a sectional view of the tube and clip of FIG. 3 with the clip partially inserted.
Figure 6:
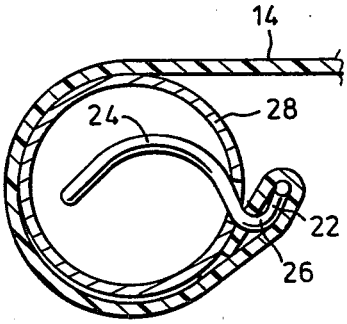
FIGS. 6 to 8 are views similar to FIG. 4, but showing successive stages of insertion of the clip.
Figure 7:
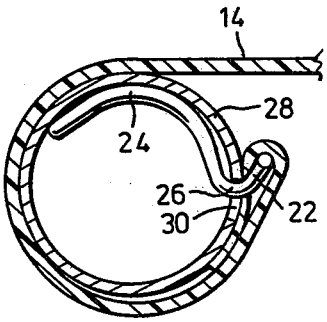

Rather, the clip with webbing material is slid around the tube from the position illustrated in FIG. 4 to cause the free end of the lead section 24 to enter the hole 30. The curvature of the lead section facilitates this entry as illustrated in FIG. 5. As the assembly is further moved around the tubing the C-shaped lead section further enters the tube until the U-bend 26 enters the hole 30. (FIG. 5). As the U-bend enters the hole it snaps into position and locks against removal (FIG. 7). Tension on the web in the direction of arrow 32 causes the side of the U-bend close to the hook section 22 to bear against the edge of the hole 30 as illustrated in FIG. 7.

Figure 8:
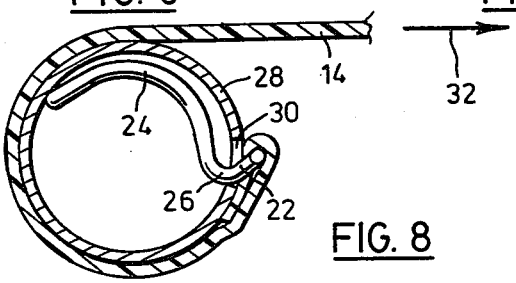

The webbing has at this stage been substantially mounted to the frame. As tension is applied to the seat, there is a tendency for the force of the webbing on the T-bar to draw the hook section more deeply into the opening 30 as illustrated in FIG. 8. When tension on the webbing is released, the clip tends to be self-locking.

In the embodiment of the invention illustrated, the C-shaped lead section adheres to the contour of the tubing and maintains the clip in the position locked against removal with the hook section extending in a forward direction even when tension on the webbing is relaxed. There is insufficient movement of the webbing on relaxation of tension to permit dislocation of the shank in sufficient amount to permit dislocation of the clip under these conditions. The C-shaped lead section of the clip will cooperate with the hook section of the clip to restrain the clip from dislodgment under these conditions.

In order to dislodge the clip once mounted in the tubing, it is necessary to move the T-bar section thereof substantially above the level of the opening 30 in order to rotate the lead section downwardly within the tube. This, in practice, does not occur with the kind of webbing with which applicant is concerned.

It will be noted that in the embodiment of the invention illustrated the T-stem is formed by a section of wire that extends downwardly from one end portion 16 of the T-bar, turns upon itself in a U-shaped bend as at 34 and then extends upwardly to the other end portion 18 of the T-bar. The T-stem is formed such that the downwardly extending portion 36 and the upwardly extending portion 38 are spaced apart in front elevation as at 40 where they communicate with the end portions 16 and 18 of the T-bar. They are so spaced apart to extend across or at least substantially across the hole in the tubing such as the hole 30 within which they are mounted. In this way they impede accidental removal of the clip from the hole and add to the security of the clip in the hole. They are preferably designed to frictionally engage with the sides of the hole.

It will also be noted that the downwardly and upwardly extending portions of wires 36 and 38 diverge from each other and then converge towards each other to form opposed notches 42 and 44 in the T-stem adjacent the T-bar. These notches are adapted to embrace the edge of the hole in a tube in use and to interlock therewith to prevent removal by accident. The wire from which the clip is formed is, of course, resilient and the downwardly and upwardly extending sections 36 and 38 in the T-stem are yieldable to approach each other to permit the edges of the hole to enter the notches as the clip is inserted into a hole.

While the clip works especially well on the less stretchable materials it also works well on the stretchable type materials that preceded them in popularity. Its use is not restricted to materials with relatively little stretch.

Once installed, the C-shaped hole searching lead section engages with the inside of the tube to maintain the axis of the hook section extending in a forward direction and the interlocking caused by the diverging sections of the T-stem further assist in the stabilization of the clip within the hole to maintain the fabric in position.

The manner of using the clip to mount webbing strips on a chair as illustrated in FIG. 1 is well known and not referred to in greater detail herein. The clip can also be used to mount a seal or back that consists of one piece of fabric as distinct from strips.

Modification to the configuration of the invention illustrated in the drawings will be apparent to those skilled in the art and it is not intended that the foregoing description should be read in a limiting sense. The advantages of the invention will be apparent to those skilled in the art. The clip can be made from wire so that material costs are low and there is no waste or trim material. It is easy to insert because of the C-shaped hole searching lead section that automatically enters the hole as the end of the webbing is slid around the tubing. The combined operation of the lead section and the hook section assures a positive locking and permanent securing of the webbing material. The diverging sections of the T-stem assist. The device does not rely upon tension of the webbing material for security and is thus especially suited to the rigid higher quality webbing materials that are presently secured into place by means of riveting or heat formation of the webbing. The clip is aesthetically acceptable because it is consealed in the piece of furniture by the webbing material. A further advantage is that the clip will function on a large variety of web thicknesses and types without modification in design.

The embodiments of the invention in which an exclusive property or privilege is claimed are defined as follows:

1. A clip for clipping an edge of a web to a tubular frame comprising a single piece of wire bent into a T-shape in front elevation having a T-bar constituted by two end portions of the piece of wire and a T-stem extending downwardly from the T-bar;

said T-stem in side elevation of said clip having a hook section that extends from said T-bar and a C-shaped hole searching lead section, the hook section and the lead section merging in a U-bend, the C-shaped hole searching lead section being adapted to engage with the inside of a tube wall to be retained against movement relative to the tube wall in use.

2. A clip for clipping an edge of a web to a tubular frame comprising a single piece of wire bent into a T-shape in front elevation having a T-bar constituted by two end portions of the piece of wire and a T-stem extending downwardly from the T-bar;

said T-stem in side elevation of said clip having a hook section that extends from said T-bar and a C-shaped hole searching lead section, the hook section and the lead section merging in a U-bend, the C-shaped and the hook section in side elevation forming a double U-bend.

3. A clip for clipping the edge of a web to a tubular frame as claimed in claim 1 or claim 2 wherein said T-stem is formed by a section of wire that extends downwardly from one end portion of the T-bar, is bent into a U-shape at the bottom of the stem and then extends upwardly to the other end portion of the T-bar, the downwardly extending portion and the upwardly extending portion of the section of wire being spaced in front elevation where they communicate with said T-bar to impede removal from a hole in a tube in use.

4. A clip for clipping the edge of a web to a tubular frame as claimed in claim 1 or claim 2 wherein said T-stem is formed by a section of wire that extends downwardly from one end portion of the T-bar, is bent into a U-shape at the bottom of the stem and then extends upwardly to the other end portion of the T-bar, the downwardly extending portion and the upwardly extending portion of the section of wire being spaced in front elevation where they communicate with said T-bar to impede removal from a hole in a tube in use wherein said spaced downwardly and upwardly extending portions of the section of wire from which the T-stem is formed are spaced where they communicate with their respective portions of said T-bar as aforesaid in front elevation, diverge from each other and then converge towards each other to form opposed notches in the T-stem adjacent the T-bar, said notches being adapted to receive the edge of the hole in a tube in use; the said wire being resilient and the downwardly and upwardly extending portions of wire from which said T-stem is formed being yieldable to approach each other to permit the edges of a hole to enter said notches in use.

* * * * *